United States Patent [19]

Preti et al.

[11] 4,137,710

[45] Feb. 6, 1979

[54] SURGE DETECTOR FOR GAS TURBINE ENGINES

[75] Inventors: Edmond Preti, North Palm Beach; Howard W. Ripy, Palm Beach Gardens, both of Fla.

[73] Assignee: United Technologies Corporation, Hartford, Conn.

[21] Appl. No.: 762,763

[22] Filed: Jan. 26, 1977

[51] Int. Cl.[2] ..... F02C 7/22

[52] U.S. Cl. ..... 60/223; 60/39.28 R

[58] Field of Search ..... 60/39.28 R, 39.28 T, 60/39.29, 226 R, 223, 261

[56] References Cited

U.S. PATENT DOCUMENTS

| | | | |
|---|---|---|---|
| 3,128,603 | 4/1964 | Haigh | 60/39.28 T |
| 3,526,384 | 9/1970 | Alberani | 60/39.28 R |
| 3,688,504 | 9/1972 | Hutchinson | 60/226 R |
| 3,739,250 | 6/1973 | Beadman | 60/39.28 T |
| 3,830,055 | 8/1974 | Erlund | 60/39.28 R |
| 3,852,958 | 12/1974 | Adams | 60/39.28 R |
| 3,867,717 | 2/1975 | Moehring | 60/39.28 R |
| 3,902,315 | 9/1975 | Martin | 60/39.28 T |
| 3,911,285 | 10/1975 | Yannone et al. | 60/39.28 T |
| 4,060,980 | 12/1977 | Elsaesser | 60/39.28 T |

*Primary Examiner*—Robert E. Garrett

*Attorney, Agent, or Firm*—Norman Friedland

[57] ABSTRACT

Sensed engine inlet temperature is utilized to detect compressor surge whenever its computed temperature rate of change or rise signal exceeds a predetermined value. This signal may be coupled to another engine operating parameter, such as rotor speed, compressor discharge pressure and the like and permutations thereof, to guard against false detection. Engine inlet temperature rate of change or rise is an efficacious surge detection parameter particularly when an afterburner is used inasmuch as the hot gases of the afterburner will have a significant influence on the engine inlet temperature sensor in a reverse flow situation making that signal a positive indication of imminent surge.

6 Claims, 1 Drawing Figure

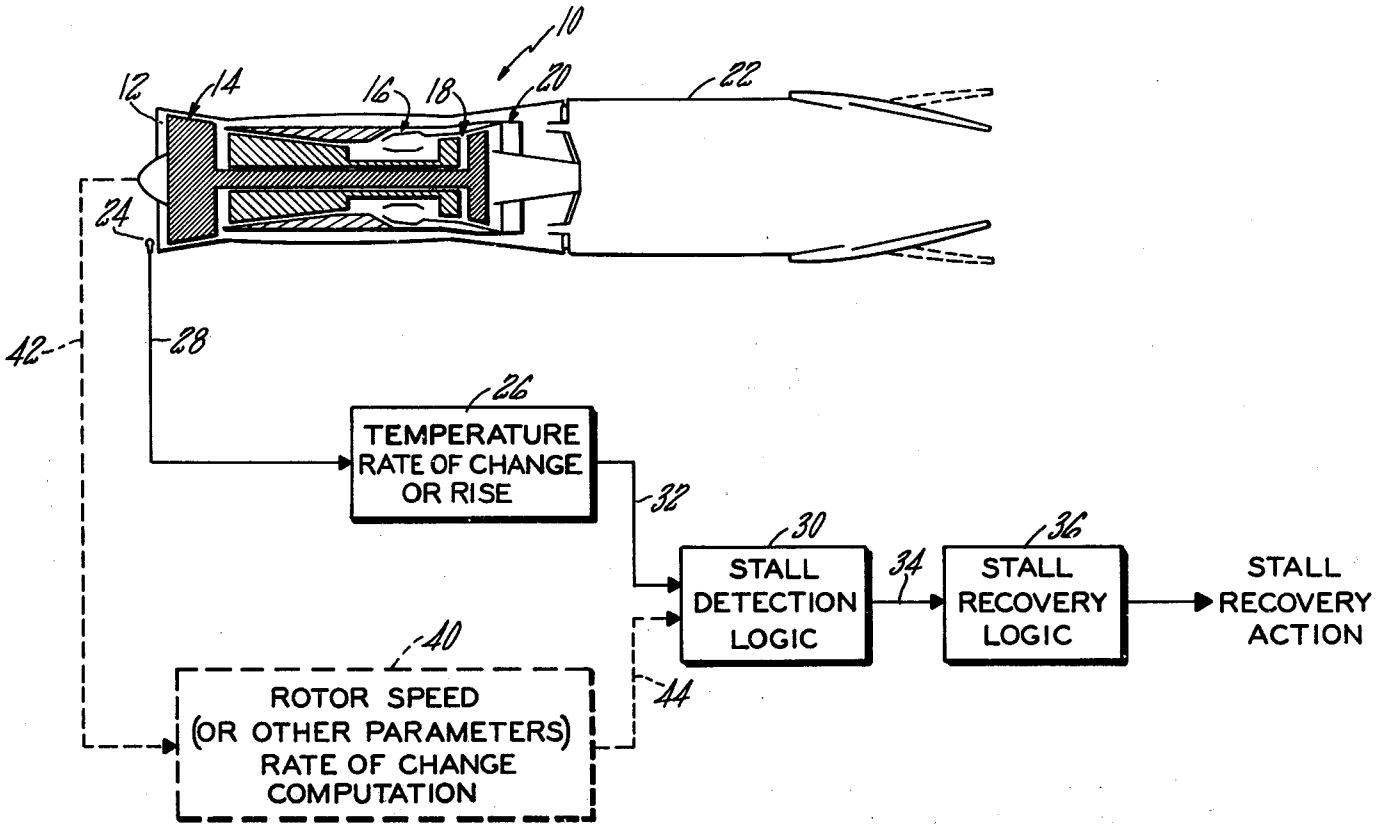
STALL RECOVERY ACTION
STALL RECOVERY LOGIC
STALL DETECTION LOGIC
TEMPERATURE RATE OF CHANGE OR RISE
ROTOR SPEED (OR OTHER PARAMETERS) RATE OF CHANGE COMPUTATION
10
12
14
16
18
20
22
24
26
28
30
32
34
36
40
42
44

SURGE DETECTOR FOR GAS TURBINE ENGINES

BACKGROUND OF THE INVENTION

This invention relates to gas turbine engines and particularly to a means for detecting surge.

As is well known, surge in an axial flow compressor gas turbine engine has been a problem perplexing the industry since its inception. While the phenomena of surge is not completely understood, suffice it to say that flow separation around the compressor blades manifests a pressure pulsation, which not only can be injurious to the engine but can result in engine failure. Also well known is the fact that the fuel control customarily comes equipped with a means for providing surge protection by scheduling a predetermined engine operation line or surge line and by monitoring and computing certain engine parameters, limits fuel flow to operate the engine below the surge line. Examples of fuel controls of the type described above are exemplified by the JFC-12, JFC-25, and JFC-60 manufactured by Hamilton Standard Division of United Technologies Corporation.

However, because the schedules are not always accurate, or owing to inaccurate sensors, or distorted signals and the like, certain engines require additional means to detect surge. For example, the U.S. Pat. No. 4,060,980 filed on Nov. 19, 1975 to F. L. Elsaesser, et al and assigned to the same assignee, and U.S. Pat. No. 3,426,322 granted to H. A. Balo on Feb. 4, 1969 disclose surge detection systems. It is important to recognize that the surge detection means described in this patent application and patent, as well as all other heretofore known surge detectors, not only require at least the measurement of two operating engine parameters, they also require instrumentation within the engine. This instrumentation normally requires access holes in the engine casings and probes protruding into the gas path.

We have found that we can obtain an efficacious surge detector by measuring engine inlet temperature rate of change or rise and generating a surge detected signal upon it reaching a predetermined value. The temperature probe can be located at the inlet of the engine, thus obviating the necessity of drilling holes into the engine case. In certain installations, as a means of protecting against false surge detection, the system may be designed to be coupled with another engine operating parameter, such as compressor rotor speed, compressor discharge pressure and the like.

SUMMARY OF THE INVENTION

An object of this invention is to provide for a gas turbine engine surge detection means responsive to the engine inlet temperature rate of change or rise.

A still further object of this invention is to provide in a surge detection system that utilizes engine inlet temperature rate of change or rise as the primary control parameter an additional parameter such as the rate of change of rotor speed, or compressor discharge pressure and the like and permutations thereof as a means for guarding against false surge detection.

Other features and advantages will be apparent from the specification and claims and from the accompanying drawing which illustrates an embodiment of the invention.

BRIEF DESCRIPTION OF THE DRAWING

The sole FIGURE is a schematic representation of a surge detection system for a gas turbine engine with augmentor.

DESCRIPTION OF THE PREFERRED EMBODIMENT

While this invention will be described in its preferred embodiment with a gas turbine engine with an augmentor, it is to be understood to those skilled in the art that it will have application for other types of installation. The use of temperature rate of change or rise as a control parameter for surge detection is particularly viable when the gases that are recirculated during a surge situation are significantly hot, say 3000° F. range, where the temperature rate of change or rise at the inlet is perceptible to the temperature probe.

As noted from the sole FIGURE, the gas turbine engine generally illustrated by reference numeral 10, includes an inlet 12, a compressor/fan section 14, burner section 16, turbine section 18, exhaust nozzle 20 and afterburner 22. Inasmuch as this invention is not primarily concerned with the engine, suffice it to say that the engine may take the form of any well-known types where surge is a characteristic of the engine, as for example the JT-8 and JT-9, manufactured by the Pratt and Whitney Aircraft Division of United Technologies Corporation and reference thereto is incorporated herein.

In accordance with this invention, a suitable, commercially available temperature probe 24 is durably mounted at the inlet of the engine and its signal is fed to computer represented by box 26 via line 28. Computer 26 serves to calculate the temperature rate of change or rise in any well-known manner commercially available to produce an output signal whenever the temperature rate of change or rise exceeds a predetermined value.

As is the case with the augmentor turned on, it has been found that the augmentor can backfire so that the flames normally issuing rearwardly reverse and flashback through the engine. This heat is perceptible at the inlet and since the flashback accompanies a surge condition, the sudden surge in heat at the inlet will signal the start of the surge condition. Whenever this output signal is manifested, it will be imposed on the stall detector illustrated by box 30 as input via line 32. If, for example, the stall detector 30 is a special purpose digital computer, it will merely assure that the logic is triggered to its initial programmed signal before accepting the output signal from the computer 26. The output from the stall detector 30 will then initiate stall recovery as being the input via line 34 to stall recovery logic represented by box 36. It also could be a digital special computer programmed to initiate stall recovery by actuating the fuel system and de-riching the gas generator, cambering the compressor variable vanes, opening compressor bleed valves, resetting the exhaust nozzle and the like.

In certain installations and under certain aircraft flight conditions, the temperature rate of change or rise at the engine inlet may produce a signal that may look like a stall signal to the control, but may not be, in fact, indicative of stall. In these instances, the surge detector control may incorporate some other engine operation parameter. Thus, for example, rotor speed sensed by a suitable sensor is fed as the input to computer 40 via line 42. Computer 40 will thus, in a well-known manner, computate its rate of change and when it reaches a predetermined value will produce an output signal. This signal is then fed via line 44 to stall detector 30. Hence, stall detector will only produce an output at 34 solely when both the temperature rate of change or rise and rotor speed rate of change signals are manifested by computers 26 and 40.

While rotor speed is described as being a viable parameter for guarding against false detection of surge, other engine operating parameters may be used in lieu thereof. It should be understood that what is taught by the invention is that engine inlet temperature, which may or may not be the total value, is a viable surge detection parameter in an afterburner gas turbine installation in and of itself.

In its preferred embodiment, this invention contemplates utilizing the rate of change value of the temperature sensed at the inlet particularly where flight or operating envelope extend over a wide range. In application where the envelope is limited the temperature rise value may be sufficient.

It should be understood that the invention is not limited to the particular embodiments shown and described herein, but that various changes and modifications may be made without departing from the spirit or scope of the novel concept as defined by the following claims.

We claim:

1. In combination, a turbine type power plant having a compressor, an engine inlet leading air into said compressor and an augmentor, means for detecting surge when it is initiated in said compressor when said augmentor is in the operating condition occasioned by the normally rearward flowing of exhaust gases reversing itself and flowing through the engine and heating the engine inlet air, said means including a sensor disposed in said inlet for measuring the temperature of the air therein, and calculating means for producing an output signal as a function of the rate of change of said measured temperature when it exceeds a predetermined value, whereby said output signal is indicative of surge in said compressor.

2. In combination as claimed in claim 1 including additional means for sensing an engine operating variable, computer means for calculating the rate of change of said engine operating variable and means for producing a surge detected signal when both the measured temperature rate of change or rise reaches a predetermined value and the rate of change of said engine operating variable reaches a predetermined value.

3. In combination as in claim 2 wherein said engine operating variable is rotor speed of said compressor.

4. A surge detection system for a gas turbine engine having a compressor and an engine inlet for leading air into said compressor, an augmentor normally issuing exhaust gases rearwardly, the surge detection system consisting essentially of means for measuring the temperature rate of change of the air in said inlet and means responsive to said temperature rate of change measuring means for producing a surge detected signal solely when said temperature rate of change exceeds a predetermined value when the direction of flow of the exhaust gases of said augmentor reverse itself and flashback through the engine.

5. A surge detection system for a gas turbine engine having an augmentor which has the propensity of forcing air rearwardly with respect to the normal forwardly axial flow of the engines working fluid, said engine including a compressor and an engine inlet for leading said working fluid into said compressor, a temperature sensor disposed in said inlet ahead of said compressor, means responsive to the temperature rate of change produced by said sensor resulting from the working medium flowing in a reverse direction occasioned by said augmentor for producing a surge signal when the temperature rate of change exceeds a predetermined value.

6. A surge detector for a gas turbine engine having a compressor, an inlet for leading air into said compressor, and an augmentor a temperature sensor disposed in said inlet for sensing the temperature of the air in said inlet during augmentor operation, a speed sensor for measuring the rotor speed of said compressor, means responsive to said temperature sensor for producing a first signal upon said temperature rate of change exceeds a predetermined value, means responsive to said speed sensor for producing a second signal when the rate of change of the rotor speed exceeds a predetermined value, and means responsive to both said first signal and said second signal for producing a third signal indicative of surge solely when both said first signal and said second signal exceed predetermined values.

* * * * *

UNITED STATES PATENT AND TRADEMARK OFFICE

CERTIFICATE OF CORRECTION

PATENT NO. : 4,137,710

DATED : February 6, 1979

INVENTOR(S) : Edmond Preti, Howard W. Ripy

It is certified that error appears in the above-identified patent and that said Letters Patent are hereby corrected as shown below:

In Column 1, insert the following paragraph before the "BACKGROUND OF THE INVENTION":

-- The Government has rights in this invention pursuant to Contract No. F33657-70-C-0600 awarded by the Department of the Air Force. --

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*